US008182070B2

(12) United States Patent
Hashimoto

(10) Patent No.: US 8,182,070 B2
(45) Date of Patent: May 22, 2012

(54) LIQUID EJECTING PRINT HEAD, LIQUID EJECTING DEVICE INCLUDING THE SAME, AND IMAGE FORMING APPARATUS INCLUDING THE SAME

(75) Inventor: Kenichiroh Hashimoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 895 days.

(21) Appl. No.: 11/717,930

(22) Filed: Mar. 13, 2007

(65) Prior Publication Data

US 2007/0229600 A1 Oct. 4, 2007

(30) Foreign Application Priority Data

Mar. 14, 2006 (JP) ..... 2006-069889

(51) Int. Cl.
*B41J 2/05* (2006.01)
*B41J 29/38* (2006.01)
*B41J 2/155* (2006.01)

(52) U.S. Cl. ..... 347/58; 347/13; 347/42

(58) Field of Classification Search ..... 347/58, 347/13, 42
See application file for complete search history.

(56) References Cited

U.S. PATENT DOCUMENTS 5,160,945 A * 11/1992 Drake ..... 347/42
6,367,914 B1 4/2002 Ohtaka et al.
6,682,185 B2 1/2004 Hashimoto et al.
6,913,348 B2 7/2005 Hashimoto et al.
7,090,325 B2 8/2006 Hashimoto et al.
2005/0231561 A1 10/2005 Hashimoto
2006/0238579 A1 10/2006 Hashimoto et al.

FOREIGN PATENT DOCUMENTS

| | | |
|---|---|---|
| JP | 7-178893 | 7/1995 |
| JP | 2000-289233 | * 10/2000 |
| JP | 2000-318188 | 11/2000 |
| JP | 2002-86741 | 3/2002 |
| JP | 2002-144576 | 5/2002 |
| JP | 2003-305853 | 10/2003 |
| JP | 2004-98473 | 4/2004 |
| JP | 3636109 | 1/2005 |
| JP | 2005-138522 | 6/2005 |

OTHER PUBLICATIONS

Nov. 29, 2010 Japanese official action in connection with a counterpart Japanese patent application.

* cited by examiner

*Primary Examiner* — Uyen Chau N Le
*Assistant Examiner* — Kajli Prince
(74) *Attorney, Agent, or Firm* — Cooper & Dunham LLP

(57) ABSTRACT

A liquid ejecting print head, which may be included in a liquid ejecting device and/or an image forming apparatus, includes a plurality of print head units arranged across a longitudinal direction of the liquid ejecting print head and aligned in a zigzag manner in a direction perpendicular to the longitudinal direction of the liquid ejecting print head, a plurality of nozzle arrays mounted on each print head unit and including a plurality of nozzle orifices for ejecting a droplet of ink, an energy generating element mounted on each print head unit and provided for each nozzle orifice for generating energy for ejecting the droplet of ink, and a wiring member including a plurality of wirings formed to run in an identical direction with respect to each print head unit and configured to transmit respective signals to the energy generating element.

18 Claims, 8 Drawing Sheets

LIQUID EJECTING PRINT HEAD, LIQUID EJECTING DEVICE INCLUDING THE SAME, AND IMAGE FORMING APPARATUS INCLUDING THE SAME

TECHNICAL FIELD

The present disclosure relates to a liquid ejecting print head including a plurality of print head units, a liquid ejecting device having the liquid ejecting print head, and an image forming apparatus including the liquid ejecting device provided with the liquid ejecting print head.

BACKGROUND

A variety of image forming apparatuses are currently available, including printers, copiers, facsimile machines, plotters, and multifunctional machines including functions of printers, copiers, and facsimile machines.

Among such image forming apparatuses, there are some image forming apparatuses that include a liquid ejecting device with a recording head. The liquid ejecting device may use the recording head to eject or spray a droplet or droplets of liquid including recording fluid onto a recording medium to form, record, or print an image while a sheet conveying member is conveying the recording medium.

A recording medium is hereinafter referred to as a "recording sheet." The recording sheet may be formed of any material such as paper.

Recording fluid is hereinafter referred to as "ink", when required.

Liquid that can be ejected or sprayed by a liquid ejecting print head includes recording fluid or ink, liquid resist, DNA samples, patterning materials, and so forth.

In response to recent demands for speeding up image forming operations, the number of high-speed image forming apparatuses is increasing.

For further increasing operation speed, image forming apparatuses may employ a line-type print head in which a distance in its longitudinal direction is equal to a width of a recording sheet.

In some instances, it may be difficult however, to form such line-type print head in one shape because of variations, yield, cost, and so forth.

As an alternative to the above-described print head having a long width in one shape, there are techniques for employing a line-type print head in which a plurality of print head units having a short distance in the longitudinal direction are aligned in a zigzag manner.

In one of the techniques, an image forming apparatus including a plurality of print head units can be used. Each print head unit may include nozzle arrays of the same number of ink colors. Respective ink droplets of the respective ink colors may be ejected from nozzle orifices of the nozzle arrays. The plurality of print head units may be aligned in a zigzag manner to form a line-type print head.

In some of the techniques, a group formed by a plurality of print head units for each single color may be aligned in a zigzag manner. By arranging the group of print head units according to the number of ink colors, a line-type print head may be formed.

There is another technique in which a group formed by a plurality of print head units for each single color may be aligned in a zigzag manner. In this technique, the group of print head units may be arranged corresponding to the number of colors of ink to form a line-type print head, so that a flexible print circuit or FPC that can serve as a wiring member can be installed from each of the plurality of print head units to be connected to both sides of the line-type print head.

In a different one of the techniques, a group formed by a plurality of print head units including nozzle orifices for four colors may be arranged in a zigzag alignment to form a line-type print head in a long shape.

Another one of the techniques arranges two print head tips aligned in a zigzag manner. Groups of the two print head tips corresponding to the number of colors of ink (in this technique, four colors) are aligned to form one print head unit. Further, a line-type print head may be formed by a plurality of print head units.

In a related art image forming apparatus including a liquid ejecting device, quality in a color image may significantly vary and depend on accuracy of positions at which each droplet of respective colors of ink lands onto a recording medium. To obtain high accuracy in landing positions of respective colors of ink, each nozzle of a print head unit included in the liquid ejecting device has high positional accuracy.

For enabling the above-described positional accuracy, the liquid ejecting device has a nozzle array, which is a series of nozzle orifices. That is, the nozzle array includes a plurality of nozzles according to the same number of colors of ink, and the plurality of nozzles for each color of ink are located in respective accurate positions in one print head unit. With the above-described configuration, the landing position of each droplet of color ink can be highly accurate.

Therefore, with a configuration in which a plurality of print head units, each of which including line-type print heads, it is preferable, for forming or creating high quality images, that one print head unit includes nozzle arrays having a plurality of nozzles according to the same number of colors of ink.

In this case, if a droplets of each color ink lands onto a recording sheet in a wrong order, printed images may have different color tones and may cause non-uniformity or unevenness, which results in deterioration in image quality.

To avoid the above-described drawback, it is preferable that print head units are aligned in an identical order with respect to each color so that droplets of respective colors of ink can lands in a same order.

Thus, a plurality of print head units including a plurality of nozzle arrays can be arranged in a first direction (i.e., a width direction of a recording sheet) and aligned in a zigzag manner in a second direction that is different from the first direction, and a line-type print head can be formed.

In this case, a signal that can activate an energy generating element may need to be sent to each print head unit. The energy generating element generates energy that can cause a corresponding nozzle of respective nozzle arrays in each print head unit to eject or spray a droplet of each color ink.

In this case, as shown in one of the above-described technologies, a FPC for supplying electrical signals may be provided from each of the plurality of print head units and connected to two opposite sides of the line-type print head.

When the above-described configuration is applied, a wiring pattern for each color in the FPC may vary on the two opposite sides of the line-type print head.

A control board that connects the FPC to the opposite sides of the line-type print head may can be provided for each side to be connected to the FPC, but such a configuration causes an increase in cost.

BRIEF SUMMARY

According to one aspect of the present disclosure, a liquid ejecting print head is provided that can use a wiring member provided in an identical direction of the liquid ejecting print head so as to use a control board in common among the plurality of print head units.

In another aspect of the present disclosure a liquid ejecting device is provided that includes the above-described liquid ejecting print head.

In another aspect of the present disclosure, an image forming apparatus that includes the above-described liquid ejecting print head is provided.

In one exemplary embodiment, a liquid ejecting print head includes a plurality of print head units configured to create an image, arranged across a longitudinal direction of the liquid ejecting print head, and aligned in a zigzag manner in a direction perpendicular to the longitudinal direction of the liquid ejecting print head. The liquid ejecting print head further includes a plurality of nozzle arrays mounted on each of the plurality of print head units, each nozzle array including a plurality of nozzle orifices configured to eject a droplet of ink, an energy generating element mounted on each of the plurality of print head units, provided for each of the plurality of nozzle orifices, and configured to generate energy for ejecting the droplet of ink, and a wiring member including a plurality of wirings configured to transmit respective signals to the energy generating element. The plurality of wirings of the wiring member may be formed to run in an identical direction with respect to each print head unit.

The wiring member may be separately provided to each of the plurality of print head units.

The plurality of print head units may be formed on the wiring member in an integrated manner.

Further, in another exemplary embodiment, a liquid ejecting device includes an ink reservoir configured to store liquid ink, and a liquid ejecting print head. The liquid ejecting print head includes a plurality of print head units configured to create an image, arranged across a longitudinal direction of the liquid ejecting print head, and aligned in a zigzag manner in a direction perpendicular to the longitudinal direction of the liquid ejecting print head, a plurality of nozzle arrays mounted on each of the plurality of print head units, each nozzle array including a plurality of nozzle orifices configured to eject a droplet of ink, an energy generating element mounted on each of the plurality of print head units, provided for each of the plurality of nozzle orifices, and configured to generate energy for ejecting the droplet of ink, and a wiring member including a plurality of wirings configured to transmit respective signals to the energy generating element and formed to run in an identical direction with respect to each print head unit.

In another exemplary embodiment, an image forming apparatus includes an ink reservoir configured to store liquid ink and a liquid ejecting print head. The liquid ejecting print head includes a plurality of print head units configured to create an image, arranged across a longitudinal direction of the liquid ejecting print head, and aligned in a zigzag manner in a direction perpendicular to the longitudinal direction of the liquid ejecting print head, a plurality of nozzle arrays mounted on each of the plurality of print head units, each nozzle array including a plurality of nozzle orifices configured to eject a droplet of ink, an energy generating element mounted on each of the plurality of print head units, provided for each of the plurality of nozzle orifices, and configured to generate energy for ejecting the droplet of ink, and a wiring member including a plurality of wirings configured to transmit respective signals to the energy generating element and formed to run in an identical direction with respect to each print head unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
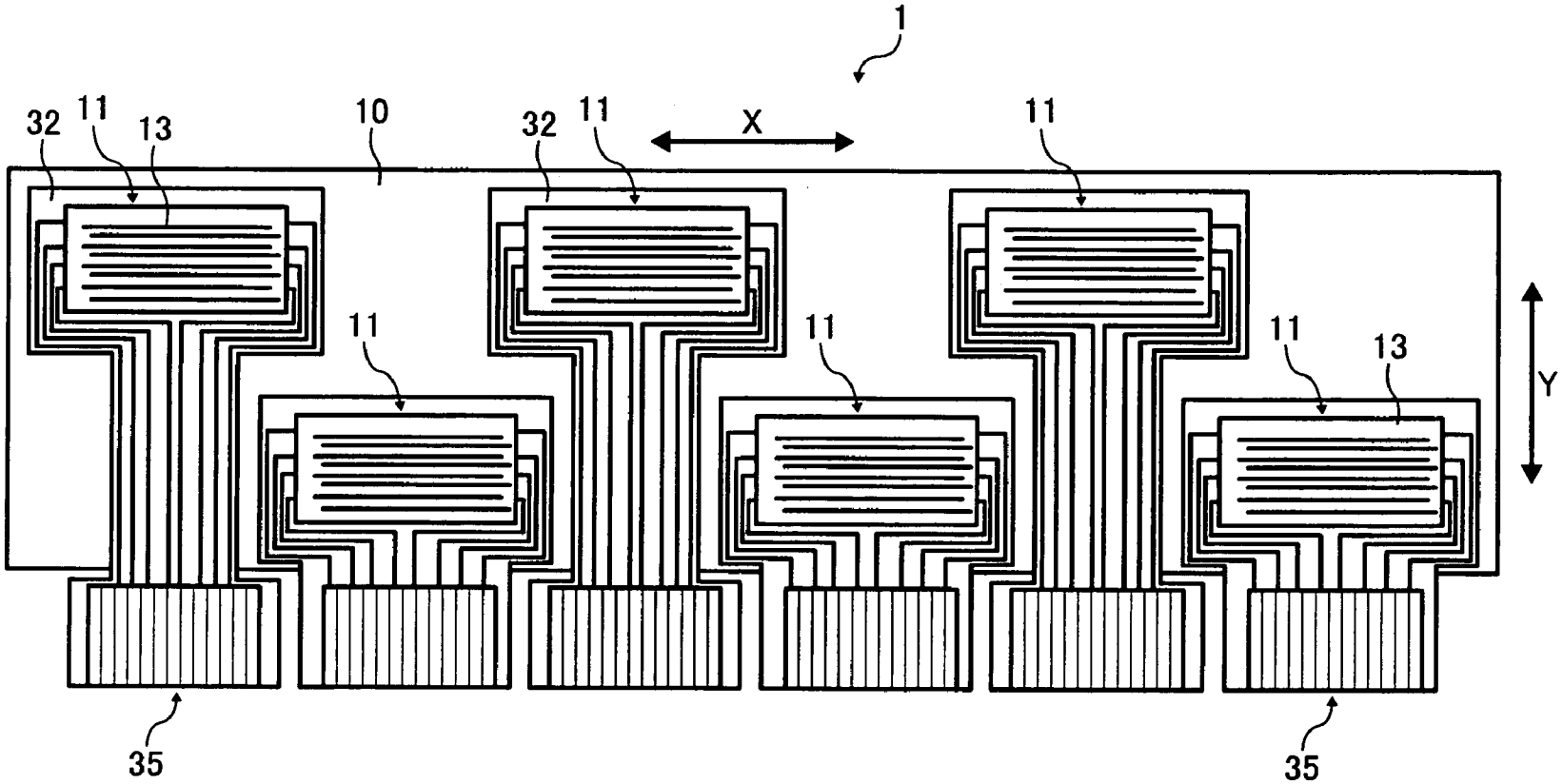
FIG. 1 is a schematic configuration of a line-type liquid ejecting print head according to a first exemplary embodiment of the present disclosure.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present disclosure are described.

Figure 2:
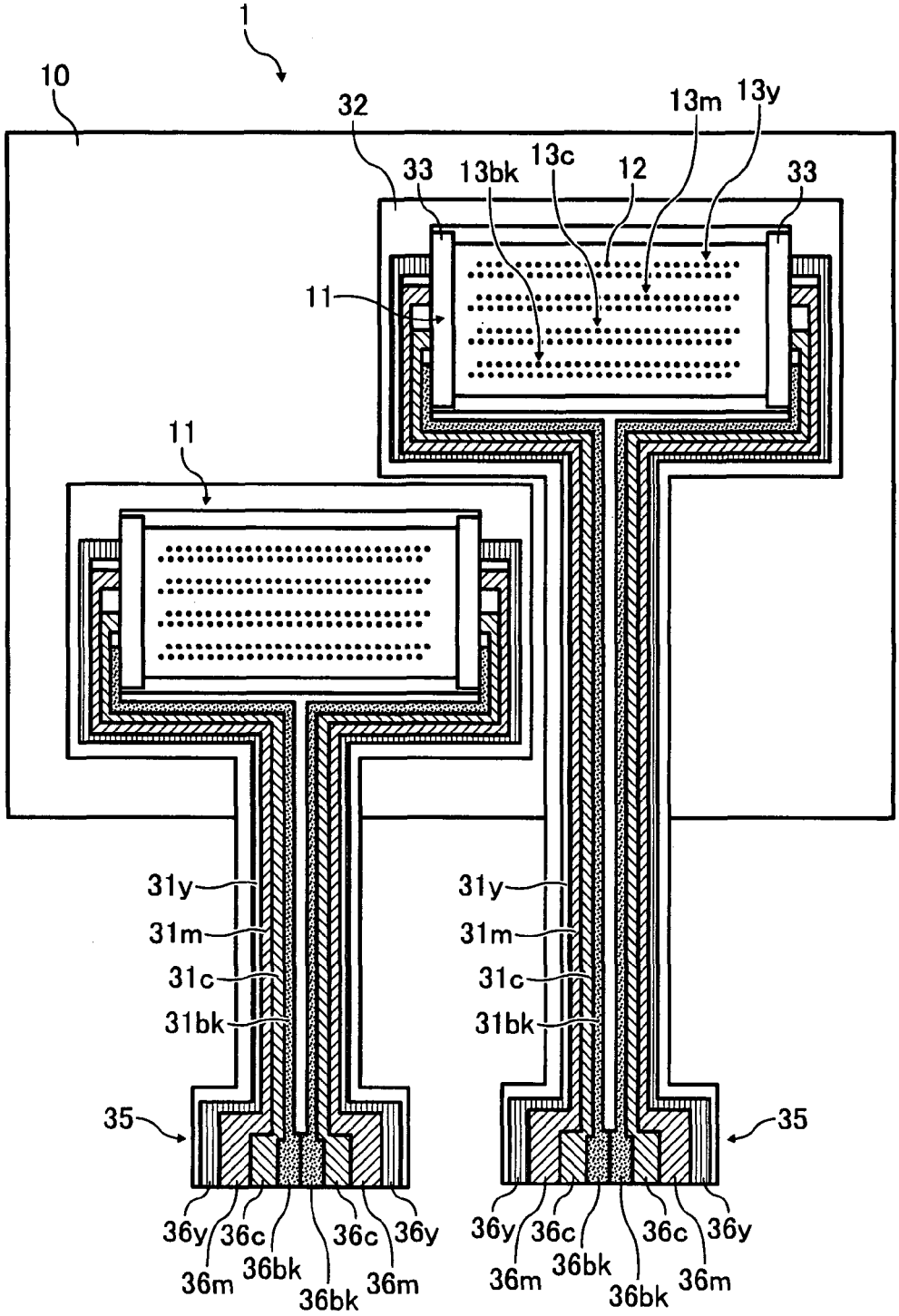
FIG. 2 is a partial enlarged view of two print head units adjacent to each other on the line-type print head of FIG. 1.

Referring to FIGS. 1 and 2, a schematic configuration of a liquid ejecting print head according to a first exemplary embodiment of the present disclosure is described. FIG. 1 is a schematic configuration of a line-type print head 1 for creating color images.

FIG. 2 is a partial enlarged view of two print head units adjacent to each other on the line-type print head of FIG. 1.

The line-type print head 1 may be a recording print head for color image.

The line-type print head 1 may be provided in a line-type image forming apparatus that can print an A4-sized recording sheet at maximum while the A4-sized recording sheet in a portrait direction is traveling in the line-type image forming apparatus.

The line-type print head 1 in the exemplary embodiment of FIGS. 1 and 2 includes a substrate 10, a plurality of print head units 11, a plurality of nozzle orifices 12, and a plurality of nozzle arrays 13.

The substrate 10 may include the plurality of print head units 11 thereon in an integrated manner.

Six print head units 11 are provided in the line-type print head 1 in the first exemplary embodiment of the present disclosure. However, the number of print head units 11 is not limited there to and any number can be applied to the line-type print head 1 according to exemplary embodiments of the present disclosure.

Similarly, the number of nozzle orifices 12 and the number of nozzle arrays 13 is not limited to any particular number and any number can be applied to the line-type print head 1 according to exemplary embodiment of the present disclosure.

Each of the six print head units 11 may include the plurality of nozzle arrays 13, each of which may be formed by the plurality of nozzle orifices 12.

The plurality of nozzles 12 may be arranged in one nozzle array 13, and the plurality of nozzle arrays 13 may be arranged across a surface of each print head unit 11 in a first direction, which is a longitudinal or width direction of each print head unit 11 indicated by "X" in FIG. 1.

Each of the plurality of nozzle arrays 13 may be arranged in a second direction, which is indicated by "Y" in FIG. 1. Specifically, the second direction is a direction perpendicular to the first direction of each print head unit 11 aligned in a zigzag manner while overlapping with an adjacent nozzle array 13.

That is, one nozzle array 13 can include the plurality of nozzle orifices 12 arranged in the first direction of each print head unit 11, and a portion of the nozzle array 13 may overlap with a portion of an adjacent nozzle array 13 in the second direction.

Specifically, each print head unit 11 can include groups of two nozzle arrays 13 with the plurality of nozzle orifices 12 arranged at intervals or pitches of 600 dpi (dot per inch), which may be a pitch of approximately 42.3 μm.

As previously described, the line-type print head 1 may be a recording print head for color image. In such instances, each print head unit 11 includes the plurality of nozzle arrays 13 for color ink. For example, the plurality of nozzle arrays 13 can include nozzle arrays 13*y* for yellow color ink (y), nozzle arrays 13*m* for magenta color ink (m), nozzle arrays 13*c* for cyan color ink (c), and nozzle arrays 13*bk* for black color ink (bk).

Each print head unit 11 can include two nozzle arrays 13*y*, two nozzle arrays 13*m*, two nozzle arrays 13*c*, and two nozzle arrays 13*bk*. Each group of the nozzle arrays 13 of same color may be aligned in a zigzag manner on the surface of each print head unit 11.

The number of nozzle orifices 12, or "N" units of nozzle orifices 12, of each nozzle array 13 may be set to 128, 256, 512, for example, in some image forming apparatuses.

In the print head unit 11 of FIG. 1, the nozzle arrays 13*y* may include the plurality of nozzle orifices 12 for ejecting or spraying droplets of yellow color ink (y), the nozzle arrays 13*m* may include the plurality of nozzle orifices 12 for ejecting or spraying droplets of magenta color ink (m), the nozzle arrays 13*c* may include the plurality of nozzle orifices 12 for ejecting or spraying droplets of cyan color ink (c), and the nozzle arrays 13*bk* may include the plurality of nozzle orifices 12 for ejecting or spraying droplets of black color ink (bk).

When a full-color image is created, three primary colors of ink, which are yellow color ink (y), magenta color ink (m), and cyan color ink (c), may be generally used. Further, four colors of ink, including black color ink (bk), may also be used when effectively showing texts and black areas of images.

When describing the nozzle arrays 13*y*, 13*m*, 13*c*, and 13*bk*, if a particular color of ink is not specified, the nozzle arrays 13 may be represented without suffixes "y", "m", "c", and "bk."

Referring to FIGS. 3 through 6, an example of the print head unit 11 according to the first exemplary embodiment of the present disclosure is described.

Figure 3:
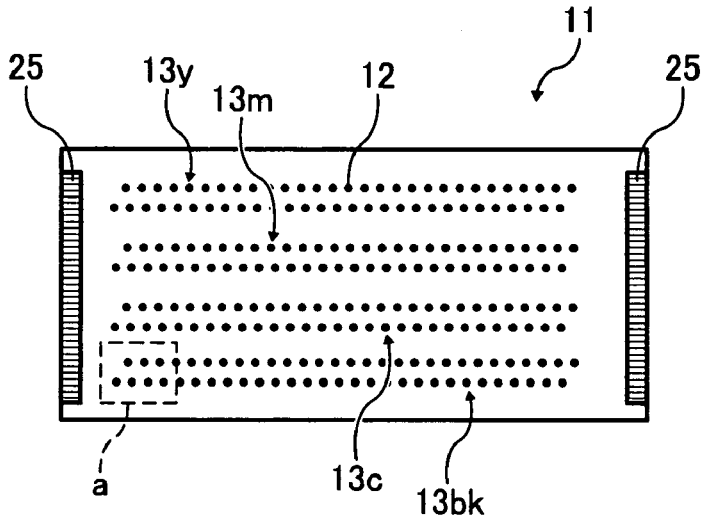
FIG. 3 is a plan view of a print head unit of the line-type liquid ejecting print head of FIG. 1.

FIG. 3 is a plan view of the print head unit 11 of FIG. 1.

Figure 4:
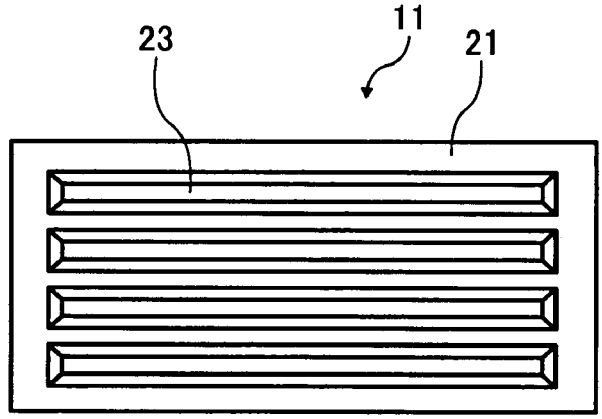
FIG. 4 is a backside view of the print head unit of the line-type liquid ejecting print head of FIG. 1.

FIG. 4 is a backside view of the print head unit 11 of FIG. 3.

Figure 5:
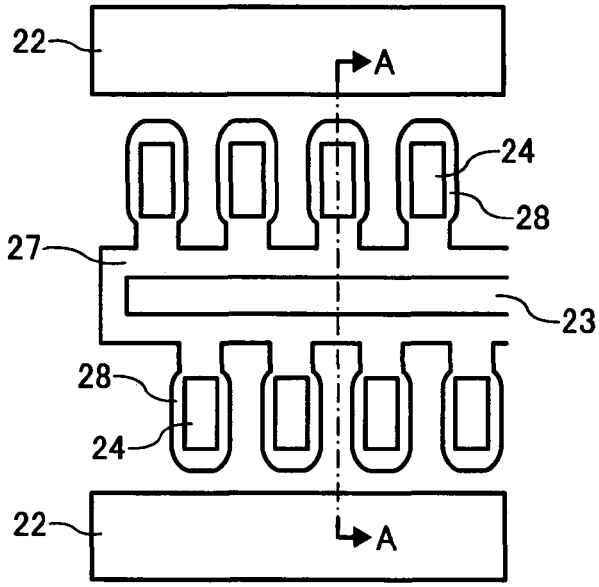
FIG. 5 is an enlarged view of a part indicated by "a" in the print head unit of FIG. 3.

FIG. 5 is an enlarged view of a part indicated by "a" in the print head unit 11 of FIG. 3.

Figure 6:
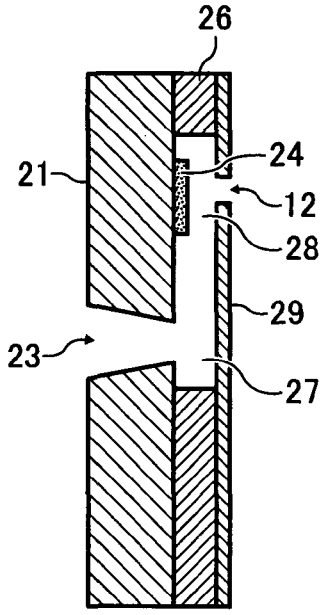
FIG. 6 is a cross sectional view of the part "a" along a line A-A in FIG. 5.

FIG. 6 is a cross sectional view of the part "a" along a line A-A in FIG. 5.

The print head unit 11 may include a thermal print head of a side shooter method.

Based on silicon LSI forming method and a thin film forming method, a plurality of heat or energy generating elements 24 (see FIG. 5), drive circuits 22 (see FIG. 5) for driving each of the plurality of heat generating elements 24, a common liquid ink reservoir 27 (see FIG. 5), separate liquid ink reservoirs 28 (see FIG. 5), and the plurality of nozzle orifices 12 may be monolithically integrated on one silicon substrate of each print head unit 11.

The print head unit 11 shown in FIGS. 1, 3, and 4 may be a print head having eight lines of the nozzle arrays 13 on a silicon substrate 21.

Among the eight lines of the nozzle arrays 13, two lines of the nozzle arrays 13*y* may fire yellow color ink (y) from the respective nozzle orifices 12*y* thereof, two lines of the nozzle arrays 13*m* may fire magenta color ink (m) from the respective nozzle orifices 12*m* thereof, two lines of the nozzle arrays 13*c* may fire cyan color ink (c) from the respective nozzle orifices 12*c* thereof, and two lines of the nozzle arrays 13*bk* may fire black color ink (bk) from the respective nozzle orifices 12*bk* thereof.

As shown in FIG. 5, drive circuits 22 may be arranged on a top surface of the silicon substrate 21 of the print head unit 11.

The drive circuits 22 may be formed according to the LSI forming method.

A liquid supply opening or ink supply opening 23 may be formed, for example, by means of wet etching through the silicon substrate 21.

The silicone substrate 21 may include the drive circuits 22 and a plurality of heat generating portions or heat generating elements 24 that may serve as heat element using the thin film forming method based on photo-lithographic technologies.

Further, the plurality of heat generating elements 24 may be connected to wiring electrode, such as common electrodes (not shown) and separate wiring electrodes (not shown).

The separate wiring electrodes may be connected to electrode terminals of the drive circuits 22.

One end portion of the silicon substrate 21 may be connected to electrode terminals 25 for connecting to an external device.

A separation wall 26 may be laminated on the entire surface of the silicon substrate 21, except the areas for the connection electrode terminals 25. The separation wall 26 may serve as a separating member.

The separation wall 26 may include an ink seal wall at one end portion thereof. The ink seal wall may block liquid ink reserved in the common liquid ink reservoir 27 from the outside thereof.

The separation wall 26 may include another ink seal at the other end portion thereof, on the separate wiring electrodes and the drive circuits 22 so that the separation wall 26 can block ink from outside.

The separate liquid ink reservoirs 28 provided corresponding to the number of the heat generating elements 24 may be formed at respective positions on which the heat generating elements 24 may be mounted.

Further, a nozzle plate 29 may be formed to cover a flowing path of liquid ink over the separation wall 26.

The eight lines of the nozzle arrays 13 that may include the plurality of nozzle orifices 12 may be formed to face the heat generating elements 24 of the nozzle plate 29.

Referring back to FIGS. 1 and 2, the details of the print head unit 11 having the above-described configuration are described.

The print head unit 11 may be fixedly mounted on the substrate 10 of the print head unit 11, together with a wiring substrate 32 that may include a metal wiring 31, i.e., metal wirings 31*y*, 31*m*, 31*c*, and 31*bk*. The wiring substrate 32 can serve as a wiring member.

The metal wiring 31 of the wiring substrate 32 may correspond to each group of two nozzle arrays 13, i.e., the nozzle arrays 13*y*, 13*m* 13*c*, and 13*bk*.

Further, groups of the metal wirings 31*y*, 31*m*, 31*c*, and 31*bk* corresponding to respective ones of the nozzle arrays 13*y*, 13*m*, 13*c*, and 13*bk* may be provided at one end portion of each print head unit 11, and another group of the metal wirings 31*y*, 31*m*, 31*c*, and 31*bk* that may correspond to different one of the nozzle arrays 13*y*, 13*m*, 13*c*, and 13*bk* may be provided at the other end portion of each print head unit 11.

Specifically, one of the metal wirings 13*y* may correspond to one of the two nozzle arrays 13*y* and may be provided to one end portion of the print head unit 11. The other one of the metal wirings 13*y* may correspond to the other one of the two nozzle arrays 13*y* and may be provided to the other end portion of the print head unit 11.

Similarly, each one of the metal wirings 13*m*, 13*c*, and 13*bk* may correspond to each one of the two nozzle arrays 13*m*, 13*c*, and 13*bk*, respectively, and may be provided to one end portion of the print head unit 11. The other ones of the metal wirings 13*m*, 13*c*, and 13*bk* may correspond to the other ones of the two nozzle arrays 13*m*, 13*c*, and 13*bk*, respectively, and may be provided to the other end portion of the print head unit 11.

It is preferable that the wiring substrate 32 may include a flexible print circuit or FPC.

The print head unit 11 and the wiring substrate 32 may be electrically connected using a wire bonding method.

Encapsulation resins 33 may cover respective portions connecting the print head unit 11 and the wiring substrate 32.

In this case, there may be two encapsulation resins 33.

As shown in FIG. 2, one of the two encapsulation resins 33 may be applied between the wiring substrate 32 and one end portion of the print head unit 11 in a longitudinal direction of the print head unit 11 or in an arranging direction of the plurality of nozzle orifices 12. Similarly, the other of the two encapsulation resins 33 may be applied between the wiring substrate 32 and the other end portion of the print head unit 11 in the longitudinal direction of the print head unit 11 or in the arranging direction of the plurality of nozzle orifices 12.

An electrical connector 35 may be mounted on the wiring substrate 32 so that electrical signals can be input thereto from an external device (not shown).

The electrical connector 35 may be connected to a control board (not shown) that may control operations performed by each print head unit 11.

The wiring substrate 32 may include a FPC board so that the FPC board can be bent, folded, or curled to guide or lead the electrical connector 35 to either side or a back surface of the line-type print head 1.

Liquid ink may be supplied from an external device (not shown) via the liquid supply opening 23 of the print head unit 11. The liquid ink may travel through the common liquid ink reservoir 27 and reach the separate liquid ink reservoir 28.

When printing an image, a recording signal may be input via the electrical connector 35, and a drive signal issued according to the recording signal may be sent via wire bonding to each heat generating element 24.

The heat generating elements 24 may be selectively turned on according to image printing data or the drive signal.

The heat generating elements 24 may generate heat within a fraction of a second and vaporize ink to form a bubble. As the bubble expands, some of the ink may be pushed out of the plurality of nozzle orifices 12 corresponding to the heat generating elements 24 and the droplets of the ink may be fired onto a recording sheet.

When creating a full-color image, a plurality of droplets according to respective ink colors may be ejected onto a recording sheet. In this case, different landing orders of the droplets of ink colors may change the color tone on a recording sheet.

Therefore, it is preferable that each print head unit 11 has the same order in arrangement of the ink colors of the nozzle arrays 13.

In this exemplary embodiment of the present disclosure, the print head units 11 on the line-type print head 1 of FIG. 1 may have the same order of color arrangement as each other, which are the order of yellow (y), magenta (m), cyan (c), and black (bk) from the top to the bottom of the print head 1 in the sheet of FIG. 1. The order of color arrangement is not limited to the above-described order, but a different order of color arrangement can be applied to the subject matter of the present disclosure.

a control board that may connect the FPC to the opposite sides of the line-type print head may need to be separately designed for-each side to be connected to the FPC, which may cause an increase in cost In a case in which each print head unit 11 has the same order in arrangement of the nozzle arrays 13 according to ink colors and the wiring substrate 32 is provided on two opposite sides of the print head unit 11, an arrangement of terminals at the electrical connector 35 of the wiring substrate 32 may be differently designed for both sides because the wiring pattern of the wiring substrate 32 is not identical in the directions to each other.

Therefore, in the present disclosure, the wiring substrate 32 forming the metal wiring 31 for each print head unit 11 may be provided in an identical direction on the print head unit 11. Specifically, as shown in FIG. 2, at the electrical connector 35 of the wiring substrate 32, the arrangement of terminals 36*y*, 36*m*, 36*c*, and 36*bk*, which may lead to the heat generating element 24 of each color via the metal wiring 31, may become identical between the print head units 11.

Accordingly, the control board to which the electrical connector 35 may be connected to can be designed for common use of parts in the print head unit 11, which can result in a reduction of costs.

Further, since the electrical connectors 35 of the respective print head units 11 may be provided in an identical direction of the line-type print head 1, a layout in an apparatus that may include the control board that may connect to the electrical connectors 35 may be easily made.

As described above, the print head unit 11 may have a configuration in which a wiring member or the metal wiring 31 for transmitting signals with respect to the energy generating unit 24 may be provided in an identical direction to each other on the print head unit 11. Therefore, the control board may be commonly used between the print head units 11, which can enable low costs.

Further, in this exemplary embodiment of the present disclosure, the wiring substrate 32 may be provided to each print head unit 11.

Manufacturing large-sized wiring boards may be difficult and may cause an increase in cost. Therefore, by providing the separate wiring substrate 32 to each print head unit 11, the line-type print head 1 can be manufactured at low cost.

Further, when manufacturing various types of image forming apparatuses according to sizes of recording sheets, a line-type print head having a length corresponding to each size of recording sheets may be required.

According to the above-described configuration, the line-type print head 1 can be applied to various types of image forming apparatuses. That is, the wiring board 32 may be separately provided to each print head unit 11. Thereby, the number of the print head units 11 may be adjusted or changed according to the size or length of the line-type print head 1. Accordingly, a common component, which may be the print head unit 11 mounted on its own wiring board 32, can be effectively applied to various types and length of line-type print heads.

Figure 7:
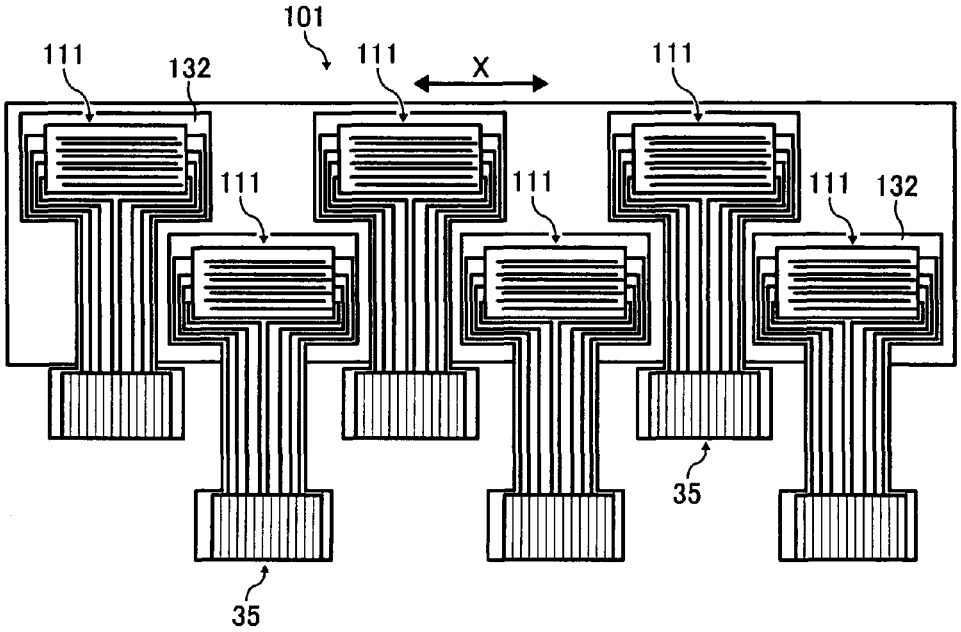
FIG. 7 is a schematic configuration of a line-type liquid ejecting print head according to a second exemplary embodiment of the present disclosure.

Referring to FIG. 7, a schematic configuration of a line-type liquid ejecting print head 101 according to a second exemplary embodiment of the present disclosure is described.

FIG. 7 is a schematic configuration of the line-type print head 101 for color recording, which is basically similar to the configuration of the line-type print head 1 of FIG. 1, except that each wiring substrate 132 may have an identical size with to each other.

In the second exemplary embodiment of the present disclosure, each print head unit 111 may be mounted on the wiring substrate 132 having one common shape as shown in FIG. 7.

With the above-described configuration, the line-type print head 101 can be provided with a single type of wiring substrate 132 for each of the print head units 111. This can enable cost reduction in components.

Figure 8:
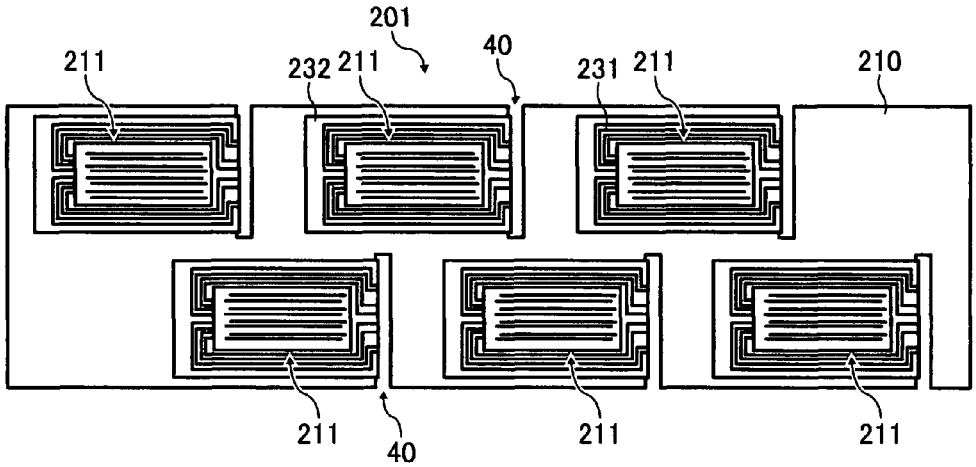
FIG. 8 is a schematic configuration of a line-type liquid ejecting print head according to a third exemplary embodiment of the present disclosure.

Referring to FIG. 8, a schematic configuration of a line-type liquid ejecting print head 201 according to a third exemplary embodiment of the present disclosure is described.

FIG. 8 is a schematic configuration of the line-type print head 201 for color recording, which is basically similar to the configuration of the line-type print head 1 of FIG. 1, except for the design of a substrate 210 and a wiring substrate 232.

In the third exemplary embodiment of the present disclosure, each print head unit 211 may be mounted on a wiring substrate 232 with metal wirings 231 provided to run in a rightward direction in FIG. 8. The wiring substrate 232 may be folded or bent toward the backside of the substrate 210 via a corresponding slit 40 formed on the substrate 210 so that the metal wirings 231 can be lead to the backside of the substrate 210 of the line-type print head 201.

Figure 9:
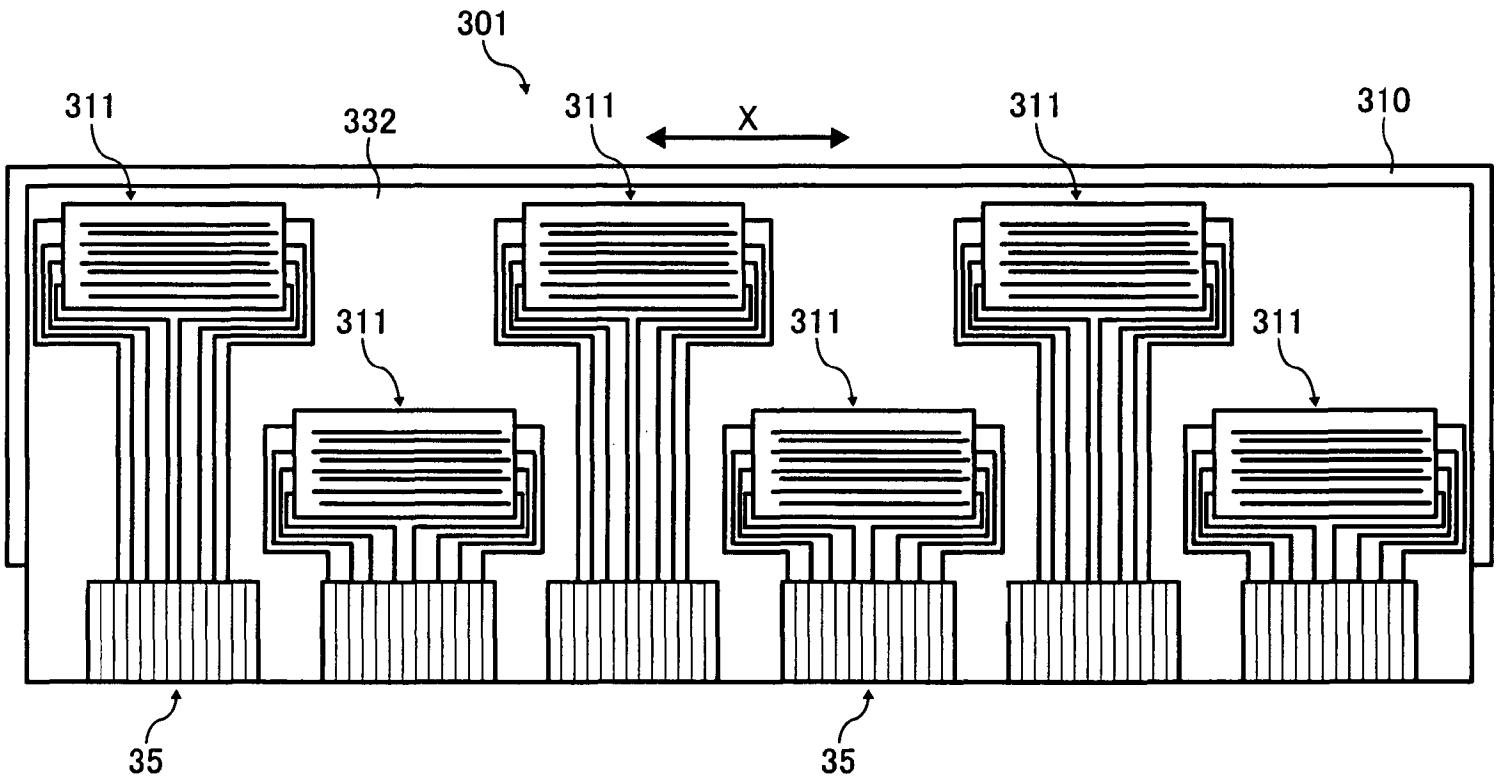
FIG. 9 is a schematic configuration of a line-type liquid ejecting print head according to a fourth exemplary embodiment of the present disclosure.

Referring to FIG. 9, a schematic configuration of a line-type liquid ejecting print head 301 according to a fourth exemplary embodiment of the present disclosure is described.

FIG. 9 is a schematic configuration of the line-type print head 301 for color recording, which is basically similar to the line-type print head 1 of FIG. 1, except for a single wiring substrate 332.

In the fourth exemplary embodiment of the present disclosure, each print head unit 311 may be mounted on the single wiring substrate 332 in an integrated manner.

Such configuration of the line-type print head 311 as shown in FIG. 9 can reduce the number of steps in a manufacturing process for aligning and bonding the wiring substrate 332 to a substrate 310, resulting in an increase of manufacturing efficiency.

The above-described configuration of the line-type print head 301 can also reduce the number of layers formed thereon.

For example, when ink or other recording fluid is clogged at the orifice of a nozzle or remains in a nozzle without being ejected, a line-type print head cannot produce an image in high quality.

To reduce or prevent such problems, a maintenance mechanism to maintain the status of the line-type print head 301 may be provided. The maintenance mechanism may include functions such as capping, wiping, and sucking ink or recording fluid.

The line-type print head 301 having the above-described configuration can enable designing the maintenance mechanism to reduce or prevent such problems by forming a plurality of nozzle orifices (not shown in FIG. 9) on a surface having less unevenness or less concavity and convexity of layers on the line-type print head 301.

In the above-described exemplary embodiments of the present disclosure, the plurality of print head units 11, 111, 211, and 311 may be arranged in a zigzag alignment in a manner of two rows. However, the number of rows of print head units is not limited. Each liquid ejecting print head 1, 101, 201, or 301 according to the first, second, third, or fourth exemplary embodiment of the present disclosure can apply a plurality of print head units arranged in a zigzag alignment in a manner of more than two rows (e.g., three rows, four rows, etc.).

Further, in the above-described exemplary embodiments of the present disclosure, image forming apparatuses employing a thermal bubble method may be applied.

Specifically, the thermal-type image forming apparatus uses an electrothermal converting element or heating element as an energy generating element to create energy or heat to fire droplets of ink from a liquid ejecting print head. The heating element is provided in a small liquid ink reservoir. When an electrical pulse is sent to the heating element, the heating element quickly warms ink stored in the small liquid ink reservoir until the ink forms a bubble at an interface between the liquid ink and the heating element. As the bubble expands, the droplets of the ink eject out from the plurality of nozzle orifices arranged on the liquid ejecting print head.

However, the line-type print heads 1, 101, 201, and 301 according to the first, second, third, and fourth exemplary embodiments of the present disclosure can apply image forming apparatuses employing a piezo-electric method can be also applied.

A piezo-electric type image forming apparatus may use an electromechanical converting element such as piezo resistive element or piezo-electric element so called "piezo crystal." A piezo crystal is located at the back of a liquid ink reservoir of each nozzle mounted on a liquid ejecting print head. When an electrical current passes through the piezo crystal, the piezo crystal mechanically changes shape. As the piezo crystal changes shape, the piezo crystal squeezes the droplets of the ink out of the nozzle or nozzle orifice of the liquid ejecting print head.

Further, the line-type print heads 1, 101, 201, and 301 according to the first, second, third, and fourth exemplary embodiments of the present disclosure can apply image forming apparatuses employing an electrostatic method can be applied.

An electrostatic liquid ejecting print head provided to an electrostatic-type image forming apparatus electrostatically change the shape of an ink reservoir or a liquid ink reservoir, which further causes to fire the droplets of the ink out of the nozzle or nozzle orifice.

Figure 10:
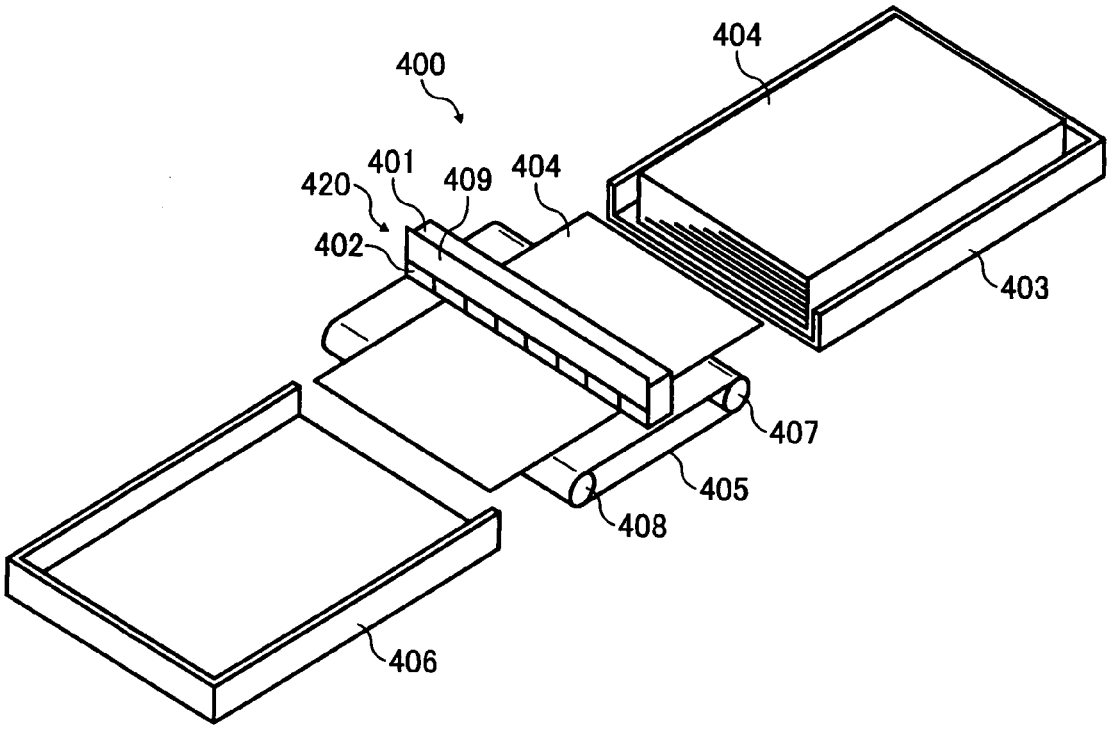
FIG. 10 is a schematic structure of an image forming apparatus and a liquid ejecting device included in the image forming apparatus, according to an exemplary embodiment of the present disclosure.

Referring to FIG. 10, a schematic structure of an inkjet-type image recording apparatus 400 that may serve as a color image forming apparatus according to at least one exemplary embodiment of the present disclosure is described.

FIG. 10 is a perspective view of the inkjet-type image recording apparatus 400.

The inkjet-type image recording apparatus 400 of FIG. 10 may include a liquid ejecting device 420 that may be provided with any one of the liquid ejecting print heads 1, 101, 201, and 301 and other components such as an ink cartridge (not shown).

Hereinafter, each one of the line-type print heads 1, 101, 201, and 301 used in the inkjet-type image recording apparatus 400 may be referred to as a "line-type print head 401."

The line-type print head 401 shown in FIG. 10 may include eight lines of nozzle arrays (not shown) on a surface thereof.

Each of the nozzle arrays may be arranged with a plurality of nozzle orifices (not shown) at an alignment pitch of approximately 42.3 μm or 600 dpi.

Among the eight lines of the nozzle arrays, two lines of the nozzle arrays may fire yellow ink (y) from the respective nozzle orifices thereof, different two lines of the nozzle arrays may fire magenta ink (m) from the respective nozzle orifices thereof, further different two lines of the nozzle arrays may fire cyan ink (c) from the respective nozzle orifices thereof, and further different two lines of the nozzle arrays may fire black ink (bk) from the respective nozzle orifices thereof.

With the above-described line-type print head 401 having these nozzle arrays, a color image may be created.

The line-type print head 401 may include eight print head units (not shown) aligned in a zigzag manner to correspond to a short width of an A4-size sheet.

Each print head unit may be provided with a wiring substrate 402, such as a FPC board as described above, such that metal wirings thereof may run in an identical direction of the wiring substrate 402 on the line-type print head 401.

The wiring substrate 402 may be connected to a control board 409 included in the inkjet-type image recording apparatus 400.

The inkjet-type image recording apparatus 400 may further include a sheet feeding tray 403, a sheet conveying belt 405, a sheet discharging tray 406, a sheet conveying belt roller 407, and a driven roller 408.

A recording sheet 404 may be placed on top of recording media accommodated in the sheet feeding tray 403.

The recording sheet 404 may be conveyed by the sheet conveying belt 405.

As the recording sheet 404 passes under the line-type print head 401, each print head unit may fire droplets of each color of ink to create and print a full-color image on the recording sheet 404.

The recording sheet 404 having a full-color image thereon may be discharged to the sheet discharging tray 406.

The sheet conveying belt 405 may be extendedly spanned around the sheet conveying belt roller 407 and the driven roller 408.

The sheet conveying belt 405 may be provided with electrodes thereon so that the recording sheet 404 can be surely conveyed. That is, the sheet conveying belt 405 may be charged at high potential to electrostatically attract the recording sheet 404 to the surface of the sheet conveying belt 405 so as to surely convey the recording sheet 404.

As described above, the present disclosure may be applied to line-type image forming apparatuses in which a liquid ejecting print head serving as a recording head may not move.

As an alternative to such line-type image forming apparatuses, the present disclosure can be applied to serial-type image forming apparatuses.

In a serial-type image forming apparatus, a liquid ejecting print head may be mounted on a carriage. While the carriage is moving in a direction perpendicular to a sheet feeding direction, the liquid ejecting print head may record or print an image on a recording sheet.

Figure 11:
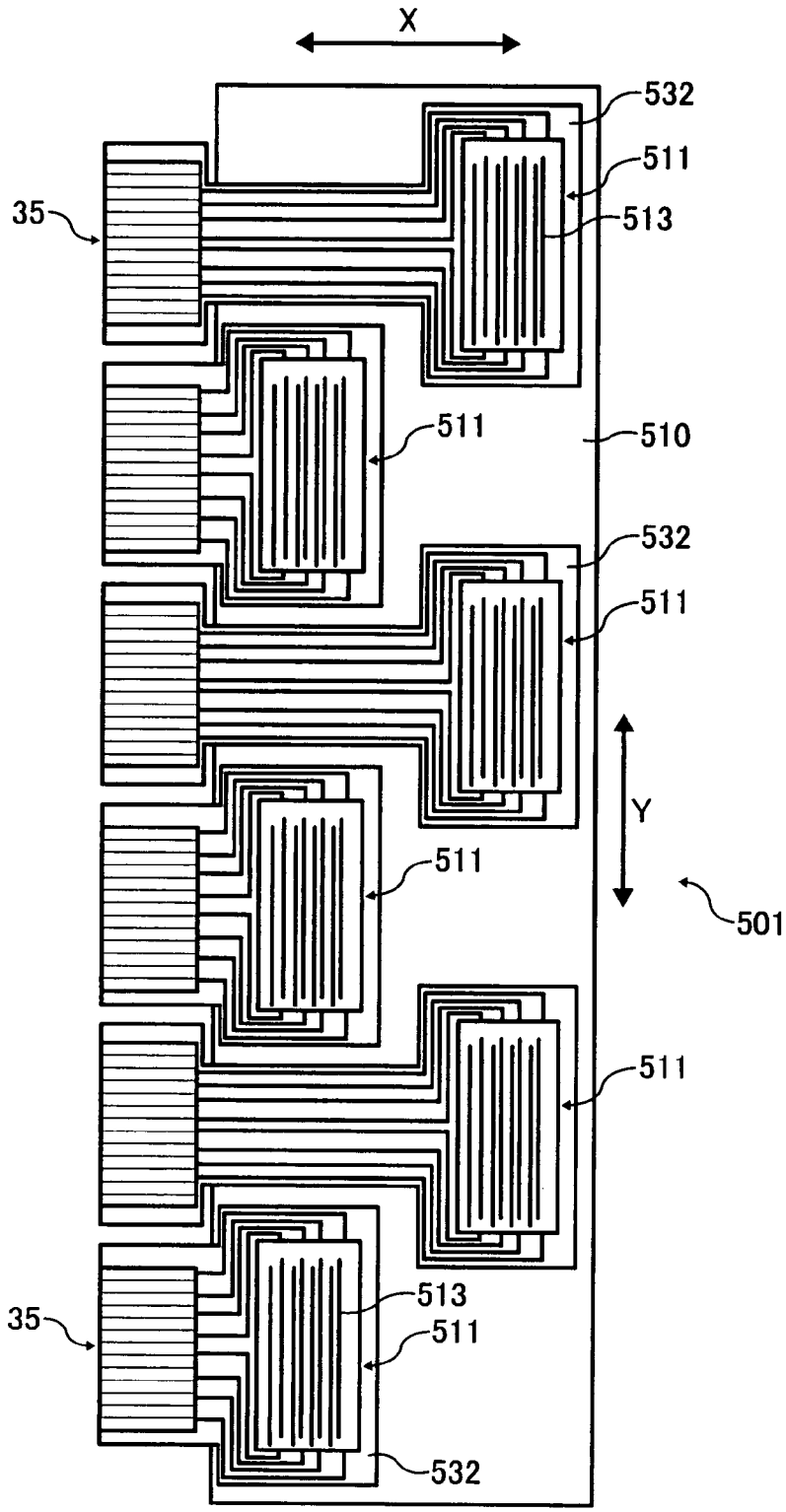
FIG. 11 is a schematic configuration of a serial-type liquid ejecting print head according to a fifth exemplary embodiment of the present disclosure.

Referring to FIG. 11, a schematic configuration of a serial-type liquid ejecting print head 501 according to a fifth exemplary embodiment of the present disclosure is described.

In FIG. 11, the serial-type liquid ejecting print head 501 according to the fifth exemplary embodiment of the present disclosure may include a plurality of print head units 511 on a substrate 510 thereof.

The substrate 510 may be formed in a rectangular shape that may extend vertically or may have a longer side in a sheet moving direction whereas a substrate such as the substrate 10 for the line-type print head 1 may extend horizontally or may have a longer side in a sheet width direction.

The serial-type print head 501 may include six print head units 511, which is the same configuration as the serial-type print head 1. However, the number of print head units 511 may not be limited and any number can also be applied to the serial-type print head 501, according to at least one exemplary embodiment of the present disclosure.

Each of the six print head units 511 may include a plurality of nozzle arrays 513, each of which may be formed by the plurality of nozzle orifices (not shown).

The plurality of nozzle orifices may be arranged in one nozzle array 513, and the plurality of nozzle arrays 513 may be arranged across a surface of each print head unit 511 in a first direction, which is a longitudinal or width direction of each print head unit 511 indicated by "X" in FIG. 11.

Each of the plurality of nozzle arrays 513 may be arranged in a second direction, which is indicated by "Y" in FIG. 11. Specifically, the second direction may be a direction perpendicular to the first direction of each print head unit 511 aligned in a zigzag manner while overlapping with an adjacent nozzle array 513.

That is, one nozzle array 513 may include the plurality of nozzle orifices arranged in the first direction of each print head unit 511, and the print head unit 511 having the nozzle arrays 513 thereon may be aligned with its adjacent print head unit 511 in a zigzag manner in the second direction.

In the fifth exemplary embodiment of the present disclosure, the serial-type liquid ejecting print head 501 may be mounted on a carriage (not shown) to move back and forth across or in a main scanning direction of a recording sheet.

A motor (not shown) that may drive the serial-type print head 501 may pause for the fraction of a second each time that the serial-type print head 501 ejects or sprays droplets of ink on a recording sheet. Then, the motor may move the serial-type print head 501 a tiny bit before stopping again. This operation of the motor may be performed so fast that it seems like a continuous motion.

With the serial-type print head 501, a printable range per one scan in a sub-scanning direction may be increased, thereby increasing a printing speed.

Specifically, while serial-type image forming apparatuses have generally used a single print head unit, the serial-type liquid ejecting print head 501 according to the fifth exemplary embodiment of the present disclosure may include the plurality of print head units 511 (for example, six print head units in this exemplary embodiment) arranged on the vertically long substrate 510 in a zigzag alignment in a sheet traveling direction or in the second direction Y.

The printing speed of a serial-type image forming apparatus may depend on the number of print head units 511. The greater the number of print head unit 511 may be, the faster the printing speed may become. That is, the serial-type liquid ejecting print head 501 that may include a large number of print head units 511 arranged in a vertically longitudinal manner in the second direction Y of the substrate 510 can obtain a large printing range or area per one scan in the main scanning direction or the first direction X of the serial-type print head 501.

Alternatively, a line-type image forming apparatus may include any of the line-type print heads 1, 101, 201, and 301, as previously described.

Such line-type print head (e.g., the line-type print head 1) may include a plurality of print heads 11 over a full printing range or area in a horizontally longitudinal manner in the main scanning direction X. The line-type print head may be fixedly disposed on the line-type image forming apparatus, and create an image by ejecting droplets of ink while a recording sheet is being conveyed. This type of print head can increase the printing speed.

According to the above-described exemplary embodiments of the present disclosure, ink may be used in the liquid ejecting print heads, the liquid ejecting devices including any one of the liquid ejecting print heads, and the image forming apparatuses including any one of the liquid ejecting print heads. However, any liquid other than ink can also be applied to the liquid ejecting print heads, the liquid ejecting devices, and the image forming apparatuses according to the present disclosure.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Numerous modifications and variations of the present disclosure are possible in light of the above teachings. It is therefore to be understood that within the scope of the appended claims, the subject matter of this disclosure may be practiced otherwise than as specifically described herein.

This application claims priority from Japanese patent application No. 2006-069889 filed on Mar. 14, 2006 in the Japan Patent Office, the entire contents of which are hereby incorporated by reference herein.

What is claimed is:

1. A liquid ejecting print head, comprising:

a plurality of print head units configured to create an image, and mounted on one surface of a substrate of the liquid ejecting print head, arranged across a longitudinal direction of the liquid ejecting print head, and aligned in a zigzag manner in a direction perpendicular to the longitudinal direction of the liquid ejecting print head;

a plurality of nozzle arrays mounted on each of the plurality of print head units, each nozzle array including a plurality of nozzle orifices configured to eject a droplet of ink;

an energy generating element mounted on each of the plurality of print head units and provided for each of the plurality of nozzle orifices, the energy generating element configured to generate energy for ejecting the droplet of ink; and a wiring member including for each print head unit of the plurality of print head units, a plurality of wirings corresponding to the print head unit and transmitting respective signals to the energy generating element corresponding to the print head unit, each of the pluralities of wirings for the plurality of print head units being formed to run in an identical wiring direction that is a lateral direction of the plurality of print head units from each print head unit to a given side of the substrate, wherein the plurality of print head units include plural distal print head units located distal in the wiring direction, and include plural proximal print head units located proximal in the wiring direction, and wherein for two adjacent ones of the plural proximal print head units, one of the plural distal print head units is located between the wirings for one of the adjacent proximal print head units and the wirings for the other of the adjacent proximal print head units, and for at least one of the proximal print head units, the wirings for the proximal print head unit passes between two adjacent ones of the plural distal print head units.

2. The liquid ejecting print head according to claim 1, wherein:

the wiring member is separately provided to each of the plurality of print head units.

3. The liquid ejecting print head according to claim 1, wherein:

the wiring member includes the plurality of print head units thereon in an integrated manner.

4. A liquid ejecting device, comprising:

an ink reservoir configured to store liquid ink; and a liquid ejecting print head, comprising:

a plurality of print head units configured to create an image, and mounted on one surface of a substrate of the liquid ejecting print head, arranged across a longitudinal direction of the liquid ejecting print head, and aligned in a zigzag manner in a direction perpendicular to the longitudinal direction of the liquid ejecting print head;

a plurality of nozzle arrays mounted on each of the plurality of print head units, each nozzle array including a plurality of nozzle orifices configured to eject a droplet of ink;

an energy generating element mounted on each of the plurality of print head units and provided for each of the plurality of nozzle orifices, the energy generating element configured to generate energy for ejecting the droplet of ink; and a wiring member including for each print head unit of the plurality of print head units, a plurality of wirings corresponding to the print head unit and transmitting respective signals to the energy generating element corresponding to the print head unit, each of the pluralities of wirings for the plurality of print head units being formed to run in an identical wiring direction that is a lateral direction of the plurality of print head units from each print head unit to a given side of the substrate, wherein the plurality of print head units include plural distal print head units located distal in the wiring direction, and include plural proximal print head units located proximal in the wiring direction, and wherein for two adjacent ones of the plural proximal print head units, one of the plural distal print head units is located between the wirings for one of the adjacent proximal print head units and the wirings for the other of the adjacent proximal print head units, and for at least one of the proximal print head units, the wirings for the proximal print head unit passes between two adjacent ones of the plural distal print head units.

5. The liquid ejecting device according to claim 4, wherein:

the wiring member is separately provided to each of the plurality of print head units.

6. The liquid ejecting device according to claim 4, wherein:

the wiring member includes the plurality of print head units thereon in an integrated manner.

7. An image forming apparatus, comprising:

an ink reservoir configured to store liquid ink; and a liquid ejecting print head, comprising:

a plurality of print head units configured to create an image, and mounted on one surface of a substrate of the liquid ejecting print head, arranged across a longitudinal direction of the liquid ejecting print head, and aligned in a zigzag manner in a direction perpendicular to the longitudinal direction of the liquid ejecting print head;

a plurality of nozzle arrays mounted on each of the plurality of print head units, each nozzle array including a plurality of nozzle orifices configured to eject a droplet of ink;

an energy generating element mounted on each of the plurality of print head units and provided for each of the plurality of nozzle orifices, the energy generating element configured to generate energy for ejecting the droplet of ink; and a wiring member including for each print head unit of the plurality of print head units, a plurality of wirings corresponding to the print head unit and transmitting respective signals to the energy generating element corresponding to the print head unit, each of the pluralities of wirings for the plurality of print head units being formed to run in an identical wiring direction that is a lateral direction of the plurality of print head units from each print head unit to a given side of the substrate, wherein the plurality of print head units include plural distal print head units located distal in the wiring direction, and include plural proximal print head units located proximal in the wiring direction, and wherein for two adjacent ones of the plural proximal print head units, one of the plural distal print head units is located between the wirings for one of the adjacent proximal print head units and the wirings for the other of the adjacent proximal print head units, and for at least one of the proximal print head units, the wirings for the proximal print head unit passes between two adjacent ones of the plural distal print head units.

8. The image forming apparatus according to claim 7, wherein:

the wiring member is separately provided to each of the plurality of print head units.

9. The image forming apparatus according to claim 7, wherein:

the wiring member includes the plurality of print head units thereon in an integrated manner.

10. The liquid ejecting print head according to claim 1, wherein:

the wiring member further includes a wiring substrate, and the plurality of wirings are provided in or on the wiring substrate.

11. The liquid ejecting print head according to claim 10, wherein at least one of the plurality of print head units is mounted on the wiring substrate.

12. The liquid ejecting print head according to claim 10, wherein an electrical connector is mounted on the wiring substrate and is configured to couple the plurality of wirings of the wiring member to an external control unit.

13. The liquid ejecting print head according to claim 1, wherein the plurality of wirings of the wiring member extends in the identical direction beyond the one surface of the substrate of the liquid ejecting print head.

14. The liquid ejecting print head according to claim 1, wherein said wiring member is a flexible member wrapped from the one surface over to a backside surface of the substrate of the liquid ejecting print head.

15. The liquid ejecting print head according to claim 1, wherein said wiring member is a flexible member configured to be extended to any one of a plurality of sides of the substrate of the liquid ejecting print head.

16. The liquid ejecting print head according to claim 1, wherein a distance as between the wirings of one of the adjacent two proximal print head units and the wirings of the other of the adjacent two proximal print head units is greater than a width, in a direction perpendicular to the wiring direction, of the one of the plural distal print head units that is between the wirings of one of the adjacent two proximal print head units and the wirings of the other of the adjacent two proximal print head units.

17. A liquid ejecting print head, comprising:

a plurality of print head units configured to create an image, and mounted on one surface of a substrate of the liquid ejecting print head, arranged across a longitudinal direction of the liquid ejecting print head, and aligned in a zigzag manner in a direction perpendicular to the longitudinal direction of the liquid ejecting print head;

a plurality of nozzle arrays mounted on each of the plurality of print head units, each nozzle array including a plurality of nozzle orifices configured to eject a droplet of ink;

an energy generating element mounted on each of the plurality of print head units and provided for each of the plurality of nozzle orifices, the energy generating element configured to generate energy for ejecting the droplet of ink; and a wiring member including for each print head unit of the plurality of print head units, a plurality of wirings corresponding to the print head unit and transmitting respective signals to the energy generating element corresponding to the print head unit, each of the pluralities of wirings for the plurality of print head units being formed to run in an identical wiring direction that is a lateral direction of the plurality of print head units from each print head unit to a given side of the substrate, wherein each of the plurality of print head units has areas where the wirings run and extend in the lateral direction of the plurality of print head units and the areas are located on the one surface of the substrate of the liquid ejecting print head.

18. A liquid ejecting print head, comprising:

a plurality of print head units configured to create an image, and mounted on one surface of a substrate of the liquid ejecting print head, arranged across a longitudinal direction of the liquid ejecting print head, and aligned in a zigzag manner in a direction perpendicular to the longitudinal direction of the liquid ejecting print head;

a plurality of nozzle arrays mounted on each of the plurality of print head units, each nozzle array including a plurality of nozzle orifices configured to eject a droplet of ink;

an energy generating element mounted on each of the plurality of print head units and provided for each of the plurality of nozzle orifices, the energy generating element configured to generate energy for ejecting the droplet of ink; and a wiring member including for each print head unit of the plurality of print head units, a plurality of wirings corresponding to the print head unit and transmitting respective signals to the energy generating element corresponding to the print head unit, each of the pluralities of wirings for the plurality of print head units being formed to run in an identical wiring direction that is a lateral direction of the plurality of print head units from each print head unit to a given side of the substrate, wherein the plurality of print head units are serially aligned in a zigzag manner with a line of distal print head units and a line of proximal print head units and, for at least three adjacent ones of the wirings for the plurality of print head units in the line of distal print head units and the line of proximal print head units, each of the plurality of print head units has areas where the wirings run and extend in the lateral direction of the plurality of print head units and the areas are located on the one surface of the substrate of the liquid ejecting print head.

* * * * *